US006160494A

United States Patent [19]

Sodi et al.

[11] Patent Number: 6,160,494

[45] Date of Patent: Dec. 12, 2000

[54] MACHINE AND METHOD FOR DETECTING TRAFFIC OFFENSES WITH DYNAMIC AIMING SYSTEMS

[76] Inventors: Paolo Sodi, Via C. Balbo 31, 50047 Prato; Roberto Sodi, Via U. Foscolo 5, 50018 scandici, Firenze, both of Italy

[21] Appl. No.: 09/230,272

[22] PCT Filed: Jul. 22, 1997

[86] PCT No.: PCT/IT97/00179

§ 371 Date: Jan. 20, 1999

§ 102(e) Date: Jan. 20, 1999

[87] PCT Pub. No.: WO98/05016

PCT Pub. Date: Feb. 5, 1998

[30] Foreign Application Priority Data

Jul. 26, 1996 [IT] Italy ..... FI96A0181

[51] Int. Cl.[7] ..... G08G 1/01

[52] U.S. Cl. ..... 340/936; 340/928; 340/933; 340/937; 348/149; 364/562; 382/103

[58] Field of Search ..... 340/936, 937, 340/938, 939, 928, 933; 342/70, 71; 73/105; 382/108, 103; 364/562, 563; 348/362, 143, 149

[56] References Cited

U.S. PATENT DOCUMENTS

| | | | |
|---|---|---|---|
| 5,404,306 | 4/1995 | Mathur et al. | 701/117 |
| 5,581,250 | 12/1996 | Khvilivitzky | 340/961 |
| 5,708,425 | 1/1998 | Dwyer et al. | 340/928 |
| 5,734,337 | 3/1998 | Kupersmit | 340/937 |
| 5,809,161 | 9/1998 | Auty et al. | 382/104 |
| 5,835,613 | 11/1998 | Breed et al. | 382/100 |
| 5,877,969 | 3/1999 | Gerber | 364/562 |
| 5,926,117 | 7/1999 | Gunji et al. | 340/988 |
| 5,963,253 | 10/1999 | Dwyer | 348/362 |

*Primary Examiner*—Edward Lefkowitz
*Assistant Examiner*—Davetta W. Goins
*Attorney, Agent, or Firm*—McGlew and Tuttle, P.C.

[57] ABSTRACT

The machine for detecting traffic offenses, comprises means (1, 3) for measuring the speed of transit (v) of a vehicle (V) along a carriageway and, connected to these, camera means (5, 7, 9) for capturing an image of the vehicle. Means (F3; 11) are also provided for detecting the transverse position (d) of the vehicle across said carriageway; the camera means are controlled as a function of said transverse position (d).

20 Claims, 3 Drawing Sheets

MACHINE AND METHOD FOR DETECTING TRAFFIC OFFENSES WITH DYNAMIC AIMING SYSTEMS

BACKGROUND

1. Field of the Invention

This invention relates to a traffic offense detection machine of the type that comprises means for measuring the speed of transit of a vehicle and, connected to these, means for capturing an image of the vehicle.

2. Prior Art

Machines of this type are currently employed, in both fixed and mobile installations, for detecting speeding or other offenses on stretches of road or freeway. The speed is normally measured by a laser system using two parallel beams a known distance apart which are intersected and hence obscured by the passing vehicle. Since the distance between the beams is known, the length of time that lapses between the obscuring of the first beam and that of the second enables the speed to be calculated. Connected to the laser transducer is a control system that operates a still camera pointing in an appropriate direction to take an image of the vehicle traveling faster than the speed limit applicable to the zone where the monitoring machine is installed. The system is adjustable to enable it to be used in areas with different speed limits.

An example of a laser-type vehicle speed detector is disclosed in, for example, U.S. Pat. No. 4,902,889, the content of which should be regarded as incorporated in the present description.

Conventional systems encounter serious problems when used on multiple-lane roadways because the image-capturing machines cannot be aimed. They must therefore have a wide enough angle of view and sufficient resolution over the whole field of view to take in the entire width of the carriageway in a single shot. This is possible with a still camera but virtually impossible with a video camera. The still camera also needs a large depth of field because the delay between the instant the speed is measured and the instant when the image is taken is set at the same value irrespective of the position of the vehicle in the transverse direction of the carriageway, i.e. irrespective of the lane in which the vehicle is traveling. The delay can, if required, be calculated as a function of the measured speed, but not of the transverse position of the vehicle, which means that the image is always taken when the vehicle (whatever its speed) is within a certain zone of the carriageway. The distance between the focal plane and the vehicle license plate therefore varies depending on the transverse position of the vehicle relative to the carriageway. Hence in order to ensure that the image is always in focus the optical system of the image acquisition means must have a sufficient depth of field. This involves high costs.

AIMS OF THE INVENTION

The subject of this invention is a machine of the type described above, which avoids the problems and limitations of conventional machines.

More specifically, one object of this invention is to provide a machine that can be used with camera means of low resolution and therefore also having a narrow angle of view, and that can in particular be used with inexpensive video cameras.

Another object of this invention is to provide a machine that can be used with camera means having a limited depth of field.

Yet another object of an improved embodiment of this invention is to provide a system capable of monitoring a multilane carriageway using a single camera means.

SUMMARY OF THE INVENTION

These and other objects and advantages, which will be clear to those skilled in the art as they read the following text, are achieved basically by using means for detecting the transverse position of the vehicle across said carriageway, the camera means being controlled as a function of said transverse position. In this way, even when using a still camera or video camera with a narrow angle of view, it is possible to monitor a wide carriageway divided into many lanes. In theory it is possible to use a plurality of camera units oriented in different directions, and the image can be captured by one or other of these, depending on the detected transverse position. It is more advantageous, however, to use a single camera unit that is oriented as and when required by rotating the unit itself or, more advantageously, by pivoting a system of reflective mirrors. This last-named solution reduces the masses in movement and hence the inertia, thereby achieving higher operational speeds.

The machine can also be used in combination with camera means that capture an image of the full width of the carriageway. In this form, control of the frame is understood in the sense that the machine is capable of identifying the position of the vehicle within the frame so as to distinguish, e.g. if several vehicles are traveling in parallel and are caught in the same frame, which car has committed the offense, and, if required, to give an indication to that effect on the image.

In order to measure the speed of transit of the vehicle it is possible, as is known, to use a laser transducer that emits and receives at least two mutually parallel laser beams. The speed is calculated as a function of the length of time that lapses between the obscuring of the first laser beam and that of the second laser beam by said vehicle. A third laser beam which is inclined at a known angle to the first two beams enables the transverse position to be determined as a function of said angle, the speed of the vehicle and the length of time that lapses between the obscuring of one of said at least two parallel laser beams and that of said third laser beam.

Other alternative, though perhaps less advantageous, systems can also be used for determining the transverse position of the vehicle, some of which are described below.

The invention also relates to a method for detecting offenses in which not only the speed of a vehicle but also its transverse position on the carriageway is detected in order then to control the angle at which the image of the vehicle is captured. Particular features and embodiments of the method according to the invention are specified in the accompanying claims.

Other advantageous features and embodiments of the invention are indicated in the dependent claims.

BRIEF DESCRIPTION OF THE FIGURES

A better understanding of the invention will be gained from the description and attached drawing, the latter showing practical, nonrestrictive embodiments of the invention. In the drawing, FIGS. 1–5 schematically show different embodiments of the machine according to the invention.

DETAILED DESCRIPTION OF THE INVENTION

Figure 1:
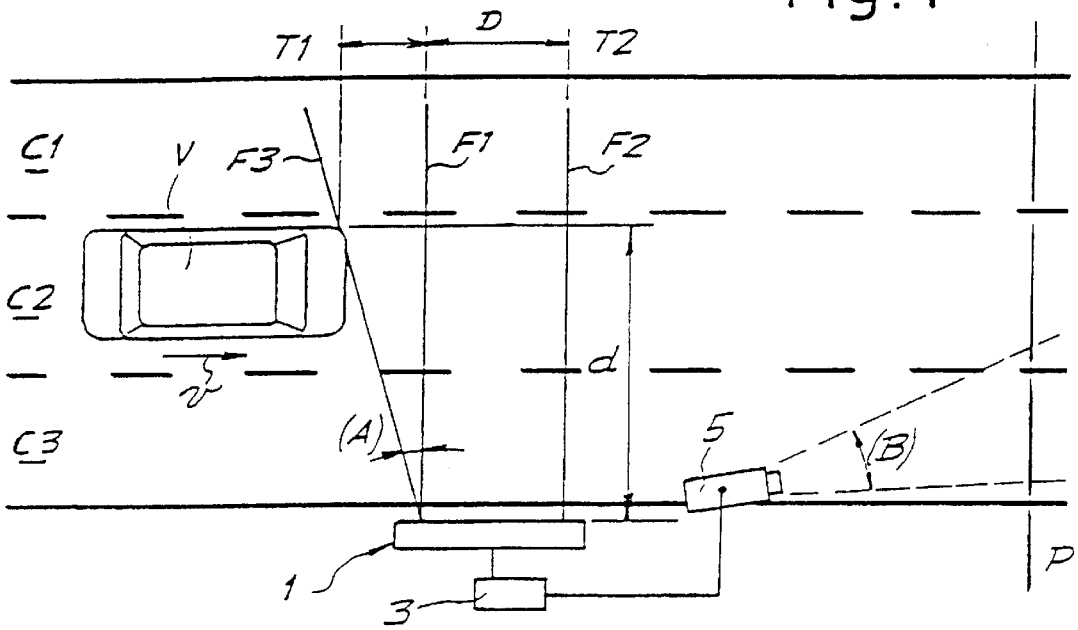

Illustrated schematically in FIG. 1, in plan view, is a portion of a multilane carriageway C1, C2, C3, such as a freeway carriageway. Along one of the lanes (the middle lane C2 in the example), a vehicle V is traveling at a speed v which it is wished to measure. Positioned to one side of the carriageway is a laser machine, bearing the general reference 1, which emits at least two mutually parallel laser beams F1 and F2 separated by a distance D and oriented transversely to the direction of travel along the carriageway. As the vehicle moves at a speed v, its front intersects the two laser beams F1 and F2 in succession, and the length of time T2 that lapses between the obscuring of the first beam and the obscuring of the second enables the value of the speed v to be calculated, since the distance D is known. The speed v, having been calculated, is sent to a central control unit, schematically indicated at 3, which sends a command signal to a camera unit 5 for photographic or video image acquisition, i.e. a still camera, video camera or the like. The camera unit 5 is activated when the calculated speed v exceeds a selectable threshold and thus captures an image of the vehicle V that is breaking the speed limit.

The signal activating the camera unit 5 may be sent after a time delay that is a function of the speed v so that the image is captured when the vehicle V reaches a particular lane section P, determined in such a way that the average distance of the vehicle V from the focal plane of the camera unit 5 is such as to give a focused image. As will be obvious from the diagram of FIG. 1, if the section P of carriageway in which the vehicle is present when the camera unit 5 takes its image is fixed, the actual distance from the vehicle V to the focal plane of the camera unit 5 will vary greatly depending on which lane C1, C2 or C3 the vehicle is in. This requires the use of optical systems with a relatively large depth of field, and such systems are expensive.

Furthermore, in order to observe the entire carriageway the optical system will require a very wide angle of view, which is not compatible with low-resolution camera means.

The still photograph can be taken from behind (as in the diagram shown in FIG. 1), or from in front by positioning the camera unit 5 further away than the machine 1 and pointing it in the opposite direction, i.e. in the direction from which the vehicles are coming.

Thus far, the machine disclosed operates in the same way as currently known conventional systems.

According to the invention, the machine is additionally provided with a means for detecting the position of the vehicle V across the width of the carriageway, so that it is known whether the vehicle is in lane C1, C2 or C3. In the illustrative embodiment shown in FIG. 1, this is done with the aid of at least a third laser beam F3 inclined at an angle (A) relative to beam F1. The front of the vehicle V intersects beam F3 before encountering beams F1 and F2 and thus generates a third signal. The length of time T1 that lapses between the instant beam F3 is obscured and the instant beam F1 is obscured depends not only on the speed v at which the vehicle is advancing but also on its transverse position relative to the carriageway. The distance d between the machine 1 and the front of the vehicle V (or more accurately the point of the vehicle V that first intersects the beam F3) is given by the equation:

$$d = T1 \times v / \tan A$$

Knowing the parameter d, the central unit 3 can operate the camera unit 5 in such a way as to direct its viewing angle (B) at lane C1, C2 or C3 or at an intermediate position where the vehicle is currently, by orienting it about a vertical axis. It is thus possible to use a camera unit 5 with a very narrow angle of view (B), which will therefore be relatively inexpensive. Alternatively, a plurality of camera units 5 with a limited angle of view, oriented at different angles, may be set up, in which case the central unit 3 will activate one or other of said camera units depending on the calculated distance d.

This possibility presented by the calculation of distance d is particularly useful when it is wished to capture images with a low-cost video camera rather than a still camera, as video cameras have poor resolution and therefore a more limited angle of view.

The system disclosed is also useful in combination with camera means having high resolution and therefore a wide viewing angle. In such a version, calculating the distance (and hence the transverse position of the vehicle relative to the carriageway) makes it possible to identify which vehicle has committed the offense, even if several vehicles appear in parallel lanes in the same picture.

Figure 2:
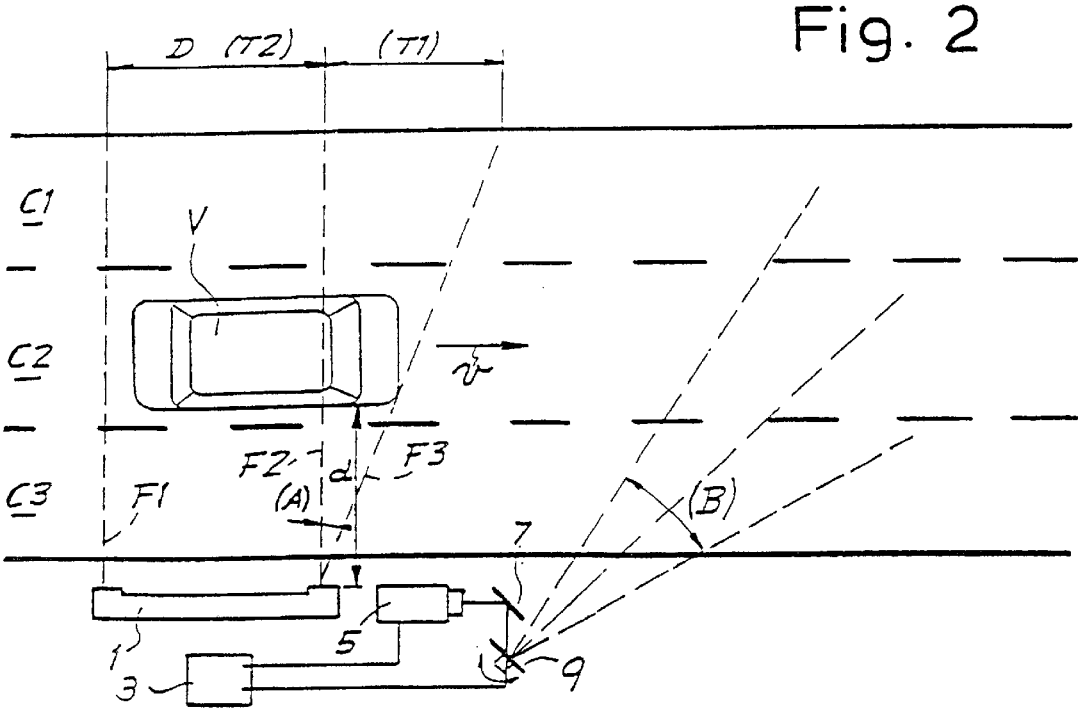

FIG. 2 schematically shows a solution equivalent to that of FIG. 1, where the third laser beam F3 is situated downline from beams F1 and F2. Identical or corresponding parts are given the same reference numerals. It is also possible to use two or more inclined beams upline and/or downline from beams F1, F2, which could, for example, enable more than one measurement to be carried out on the same vehicle.

As far as the camera unit 5 is concerned, an embodiment is shown in FIG. 2 that uses a single fixed camera unit 5 and two mirrors 7, 9 arranged in front of the lens of the unit 5. Mirror 7 is fixed and mirror 9 can be turned about a vertical axis. By this means the viewing angle of the camera unit 5 is modified by controlling the position of mirror 9 while keeping the camera unit 5 immobile. It will be obvious that this solution can also be adopted in the example shown in FIG. 1. In general terms the following can be adopted to suit specific requirements in each of the examples illustrated as alternatives: a plurality of variously oriented camera units, an orientable unit, a fixed unit with orientable mirror, or a high-resolution unit.

Figure 3:
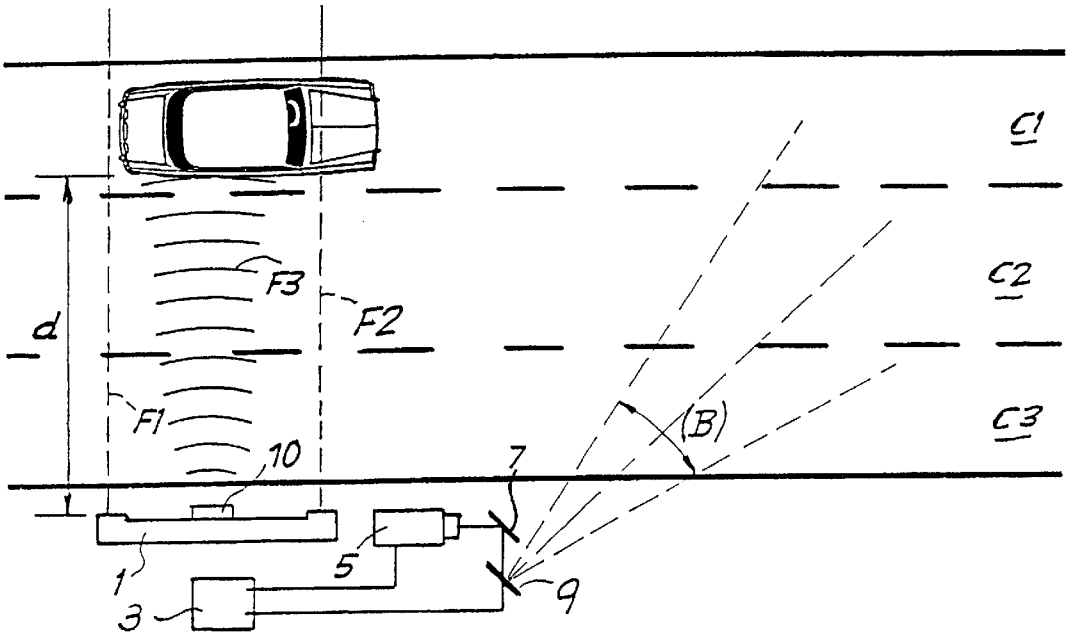

FIG. 3 shows another embodiment of the invention, in which the distance d between the vehicle V and the machine 1 is determined by means of a beam of electromagnetic radiation F3 or of sound waves emitted by emitting/receiving means 10 (known per se), reflected from the side of the vehicle V and received by the means 10. The distance d is calculated in this case from the length of time taken by the wavefront to complete a round trip. The cost of this system is higher than that of the system that uses an inclined third laser beam.

Figure 4:
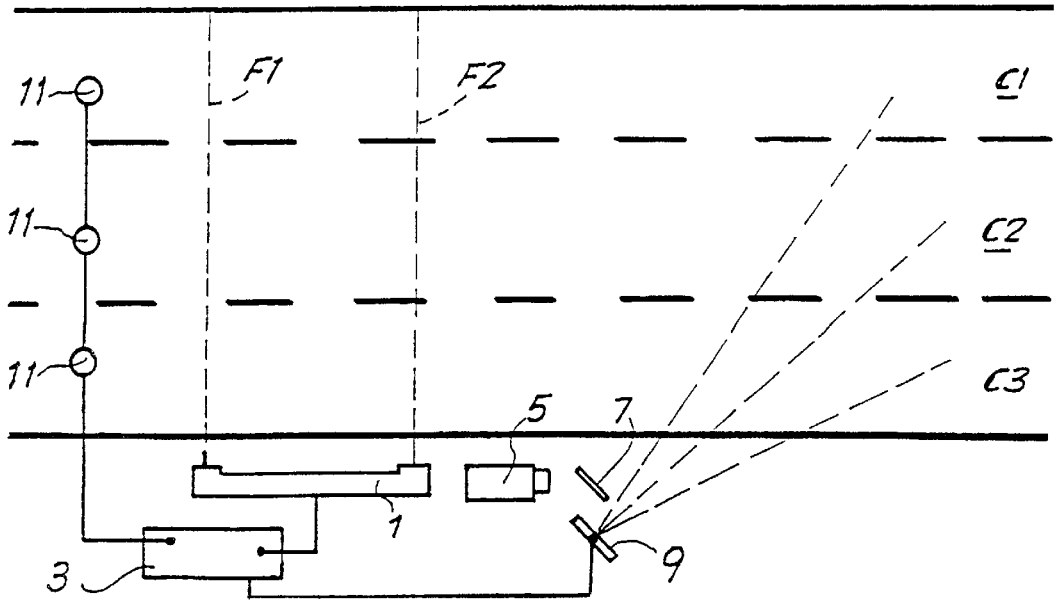

FIG. 4 shows another embodiment that makes use of a system of transducers 11 laid out transversely across the carriageway. Possible examples that may be used are magnetic position transducers that sense the passage of the metallic mass of the traveling vehicle, or other systems capable of detecting the passage of the vehicle. Parts identical or corresponding to those of the previous illustrative embodiments are indicated by the same reference numerals.

Figure 5:
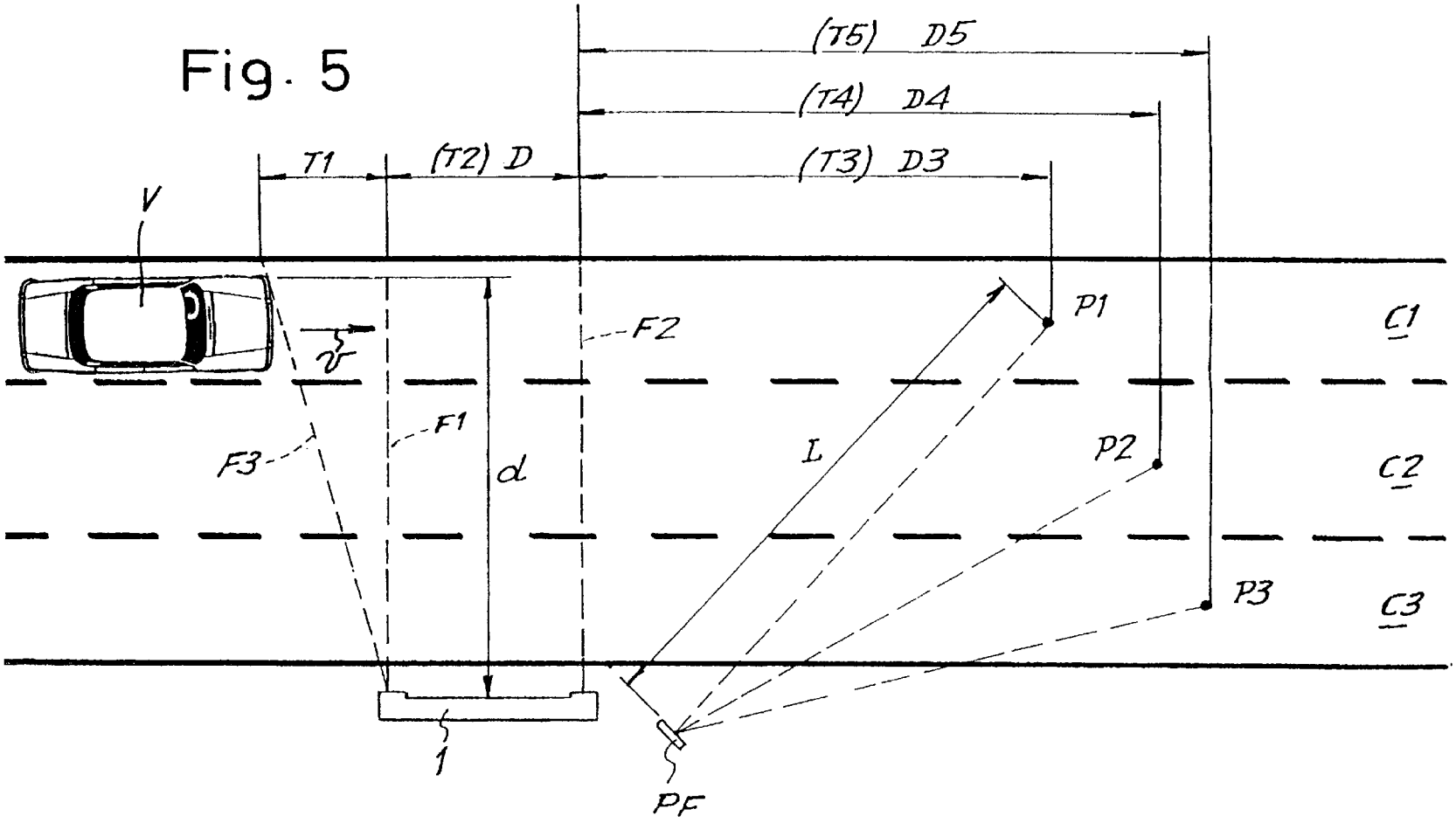

FIG. 5 shows how the system according to the invention can also provide better focusing with a more restricted depth of field than camera unit 5. Whereas in conventional systems the image is captured as the vehicle V passes through section P (FIG. 1) of the carriageway, without taking account of the transverse position of the vehicle, i.e. of which lane C1, C2 or C3 it is traveling in, with the system according to the invention it is possible to calculate the delay between speed detection and image capture as a function of the transverse position of the vehicle, so that the license plate of the vehicle is always approximately at the same distance from the focal plane of the camera unit 5, irrespective of which lane C1, C2 or C3 the vehicle is traveling in. FIG. 5 schematically indicates the focal plane PF of the camera unit 5. L denotes the distance at which the object to be photographed is correctly in focus on the focal plane PF. P1, P2 and P3 are the points where the vehicle V must be in order to produce a focused image, depending on whether said vehicle is traveling in lane C1, C2 or C3. The three points P1, P2, P3 are at distances D3, D4 and D5 respectively from the transverse line defined by beam F2. These distances correspond to traveling times T3, T4 and T5 which are dependent upon the speed v of movement of the vehicle V.

Consequently, when the speed v and the distance d of the vehicle V have been determined, it is possible to calculate what delay (T3, T4 or T5) is necessary before the image is captured in order for the latter to be correctly in focus.

It will be understood that the drawing shows only an example given purely as a practical demonstration of the invention, it being possible for said invention to vary as regards shapes and arrangements without thereby departing from the scope of the underlying concept of the invention. The presence of any reference numerals in the accompanying claims is for the purpose of facilitating the reading of the claims with reference to the description and drawing, and does not limit the scope of the protection represented by the claims.

What is claimed is:

1. A machine for detecting vehicle traffic offenses, the machine comprising:

speed detection means for measuring the speed of transit of a vehicle along a carriageway by detecting the interception of a beam or field by the front or rear of the vehicle, said speed detection means being arranged on a side of the carriageway;

carriageway transverse position detection means for detecting a transverse position of the vehicle across the carriageway by detecting the interception of a beam or field by the front or rear of the vehicle, said carriageway transverse position detection means being at least partially arranged on a side of the carriageway; and camera means for capturing an image of the vehicle, said camera means being connected to said speed detection means and to said carriageway transverse position detection means, said camera means being controlled as a function of said traverse position.

2. The machine as claimed in claim 1, wherein said camera means includes a camera unit with a viewing angle oriented as a function of the detected transverse position.

3. The machine as claimed in claim 1, wherein said camera means includes multiple camera units oriented in different directions, the image of the vehicle being captured by one of said units selected as a function of the detected transverse position.

4. The machine as claimed in claim 2, wherein said camera unit is fixed and said camera means further includes a reflection system controlled as a function of said transverse position, said reflection system being used to orient the viewing angle of said camera unit.

5. The machine as claimed in claim 1, wherein said carriageway transverse position detection means includes laser transducer that emits and receives at least a first laser beam and a mutually parallel second laser beam, said speed being calculated as a function of a length of time that lapses between the obscuring of said first laser beam and that of said second laser beam by the vehicle.

6. The machine as claimed in claim 5, wherein said carriageway transverse position detection means includes said laser transducer, said laser transducer generating at least a third laser beam which is inclined at a known angle to said first laser beam and said second laser beam, and wherein a transverse position of the vehicle is determined as a function of said angle, the speed of the vehicle and the length of time that lapses between the obscuring of said first laser and said second laser and said third laser beam.

7. The machine as claimed in claim 1, wherein said carriageway transverse position detection means includes position transducers arranged transversely across the carriageway.

8. The machine as claimed in claim 1, wherein said camera means includes a camera with a viewing angle such that it can capture an image of more than one lane of the carriageway, and in which the detection of said distance makes it possible to identify the vehicle that has committed the offense from among a plurality of vehicles traveling in parallel.

9. The machine as claimed in claim 1, wherein said carriageway transverse position detection means and said speed detection means comprise a common laser transducer and a common control unit, said common laser transducer emitting and receiving at least a first laser beam and a mutually parallel second laser beam with said common control unit calculating the speed as a function of a length of time that lapses between the obscuring of said first laser beam and that of said second laser beam by the vehicle and said laser transducer generating at least a third laser beam which is inclined at a known angle to said first laser beam and said second laser beam, and wherein said common control unit determines a transverse position of the vehicle as a function of said angle, and the length of time that lapses between the obscuring of said first laser and said second laser and said third laser beam, said carriageway transverse position detection means being arranged on a side of the carriageway.

10. A method for detecting vehicle offenses under the traffic regulations, the process comprising the steps of:

measuring the speed of transit of a vehicle along a carriageway by detecting the interception of a beam or field by the front or rear of the vehicle with a detector device arranged at the side of the carriageway;

detecting the transverse position of the vehicle on said carriageway by detecting the interception of a beam or field by the front or rear of the vehicle with a detector at least partially arranged on a side of the carriageway;

capturing an image of the vehicle; and, controlling the capturing of the image as a function of the transverse position.

11. The method as claimed in claim 10, wherein said step of capturing an image includes using a plurality of camera units set up and oriented at different angles and wherein one or another of said units is selected as a function of the detected transverse position.

12. The method as claimed in claim 10, wherein the viewing angle of a camera unit is oriented as a function of the detected transverse position.

13. The method as claimed in claim 10, wherein said speed is measured and said position is detected with the step of using at least three laser beams, including providing two laser beams that are mutually parallel and providing a third laser beam that is inclined at a known angle to the two laser beams that are mutually parallel.

14. The method as claimed in claim 10, wherein said transverse position is detected on the basis of the transit time of a wavefront reflected from the side of the vehicle.

15. The method as claimed in claim 10, further comprising the step of:

delaying the step of capturing an image following the detection of the speed; and determining said delay as a function of the transverse position of the vehicle.

16. The method as claimed in claim 10, wherein said step of capturing an image includes capturing an image of two or more lanes on which vehicles are traveling in parallel, and the method further comprises distinguishing the vehicle that has committed the offense on the basis of said transverse position.

17. A machine for detecting vehicle traffic offenses, the machine comprising:

speed detection means for measuring the speed of transit of a vehicle along a carriageway, said speed detection means being arranged on a side of the carriageway;

carriageway transverse position detection means for detecting a transverse position of the vehicle across the carriageway said carriageway transverse position detection means being at least partially arranged on a side of the carriageway, said carriageway transverse position detection means including one of:

a laser beam provided by a transducer arranged on a side of the carriageway, the laser beam not being perpendicular to the vehicle advancing direction;

a transverse beam provided by a transducer arranged on a side of the carriageway; or a fixed sensor arrangement located on the carriageway; and camera means for capturing an image of the vehicle, said camera means being connected to said speed detection means and to said carriageway transverse position detection means, said camera means being controlled as a function of said transverse position.

18. The machine as claimed in claim 17, wherein said carriageway transverse position detection means and said speed detection means comprise a common laser transducer and a common control unit, said common laser transducer emitting and receiving at least a first laser beam and a mutually parallel second laser beam with said common control unit calculating the speed as a function of a length of time that lapses between the obscuring of said first laser beam and that of said second laser beam by the vehicle and said laser transducer generating at least a third laser beam which is inclined at a known angle to said first laser beam and said second laser beam, and wherein said common control unit determines a transverse position of the vehicle as a function of said angle, and the length of time that lapses between the obscuring of said first laser and said second laser and said third laser beam, said carriageway transverse position detection means being arranged on a side of the carriageway.

19. The machine as claimed in claim 17, wherein said camera means includes a camera unit with a viewing angle oriented as a function of the detected transverse position.

20. The machine as claimed in claim 17, wherein said camera means includes multiple camera units oriented in different directions, the image of the vehicle being captured by one of said units selected as a function of the detected transverse position.

* * * * *